US006775926B1

(12) United States Patent
Huang

(10) Patent No.: US 6,775,926 B1
(45) Date of Patent: Aug. 17, 2004

(54) SHOE SOLE STRUCTURE

(75) Inventor: Jian-Hua Huang, Sanchung (TW)

(73) Assignees: Hsiu-Lan Huang Yeh, Sanchung (TW); Ping-Hsiang Huang, Sanchung (TW)

( * ) Notice: Subject to any disclaimer, the term of this patent is extended or adjusted under 35 U.S.C. 154(b) by 0 days.

(21) Appl. No.: 10/439,178

(22) Filed: May 16, 2003

(51) Int. Cl.[7] ..... A43B 7/08
(52) U.S. Cl. ..... 36/3 B
(58) Field of Search ..... 36/3 B, 3 R, 3 A

(56) References Cited

U.S. PATENT DOCUMENTS

| | | | | | |
|---|---|---|---|---|---|
| 4,888,887 | A | * | 12/1989 | Solow | 36/3 R |
| 5,299,368 | A | * | 4/1994 | Liu | 36/3 B |
| 5,606,806 | A | * | 3/1997 | O'Dwyer | 36/3 B |
| 6,463,679 | B1 | * | 10/2002 | Buttigieg | 36/3 B |
| 6,655,048 | B2 | * | 12/2003 | Moretti | 36/3 R |
| 2001/0007176 | A1 | * | 7/2001 | Attilieni | 36/3 B |
| 2003/0136023 | A1 | * | 7/2003 | Chen | 36/3 R |

* cited by examiner

*Primary Examiner*—Ted Kavanaugh
(74) *Attorney, Agent, or Firm*—Dennison, Schultz, Dougherty & MacDonald

(57) ABSTRACT

A better structure of bottom, which is to settle two sliding seats on the inner peripheral of the bottom, and since it is settled with an inclination angel, there is a sliding block roughly the same size as the sliding manager settled within such said sliding seat so that it could make movement up-and-down, and there penetrates a vein on both sides of the sliding seat wherein a vein is penetrating outside the bottom and another vein is penetrating outside the inner sides; when normal, said sliding block will seal the vein to avoid the water flowing through the vein; when the uses are walking, the sliding block settled inside the sliding seat of the bottom will slide ahead to open the vein so that the air will enters into the bottom through said vein and is transported inside the shoe such that the there will be full of fresh air to achieve the purpose of clean the bottom of the shoe the user wears.

5 Claims, 7 Drawing Sheets

SHOE SOLE STRUCTURE

BACKGROUND OF THE INVENTION

1.Field of the Invention

This invention relates to a sole structure for a shoe and more particularly to a sole structure having a sliding block in a sliding seat within the sole.

2. Description of the Prior Art

Some individuals are troubled by foot odor and excess heat during extending periods of time. For example, when an individual wears shoes for a long period of time the foot is enclosed within a tiny space which causes sweating and foot odor. These foot odors prevail even after taking off the shoes which may cause embarrassment. Further, there may be problems with athletes feet which makes the situation more troublesome. Accordingly, it is presently believed that there is a need for an improved sole structure which allows fresh air to circulate through the shoe.

SUMMARY OF THE INVENTION

The major object of the invention is to provide an improved structure of a shoe sole so that when an individual is walking, a sliding block will slide ahead such that a vent is open to let the air enter into the inside of the shoe.

Another object of the invention is to provide a better structure of the sole to prevent water from entering the vent since the vent is closed by the closure of the sliding block.

Another purpose of the invention is to provide a better structure of the sole which, when the air enters into the shoe, the air will enter into the shoe through each guide channel inside the sole to achieve the object of comfort.

The structure of a sole for achieving the abovementioned object comprises a sole, a sliding seat, a water-proof ring; wherein a shoe sole structure comprises a bottom sole having two lateral sides, a plurality of interconnected compartments and an inner sole having a plurality of openings therein. The inner sole covers the interconnected compartments or rests thereon. The structure also includes a hollow slide chamber in each of the two lateral sides and each of the hollow slide chambers have a wider upper portion and a narrower lower portion. A slide block having a wider upper portion and a narrower lower portion is disposed in each of the slide chambers and constructed and arranged to slide back and forth in the slide chamber. A vent on each side of the hollow chamber is provided for allowing air to pass there through when the slide block is in a first or open position. A tubular element including an outer ring and each end thereof connects the vent in the hollow chamber with the atmosphere for allowing air to flow from the atmosphere into the hollow chamber when the slide block is in the first position. When the slide block is in a second position, the slide block closes the opening in the hollow chamber to thereby prevent water from entering the sole through the tubular element.

BRIEF DESCRIPTION OF THE DRAWINGS

The invention will now be described in connection with the following drawings.

DETAILED DESCRIPTION OF THE REFERRED EMBODIMENT

Figure 1:
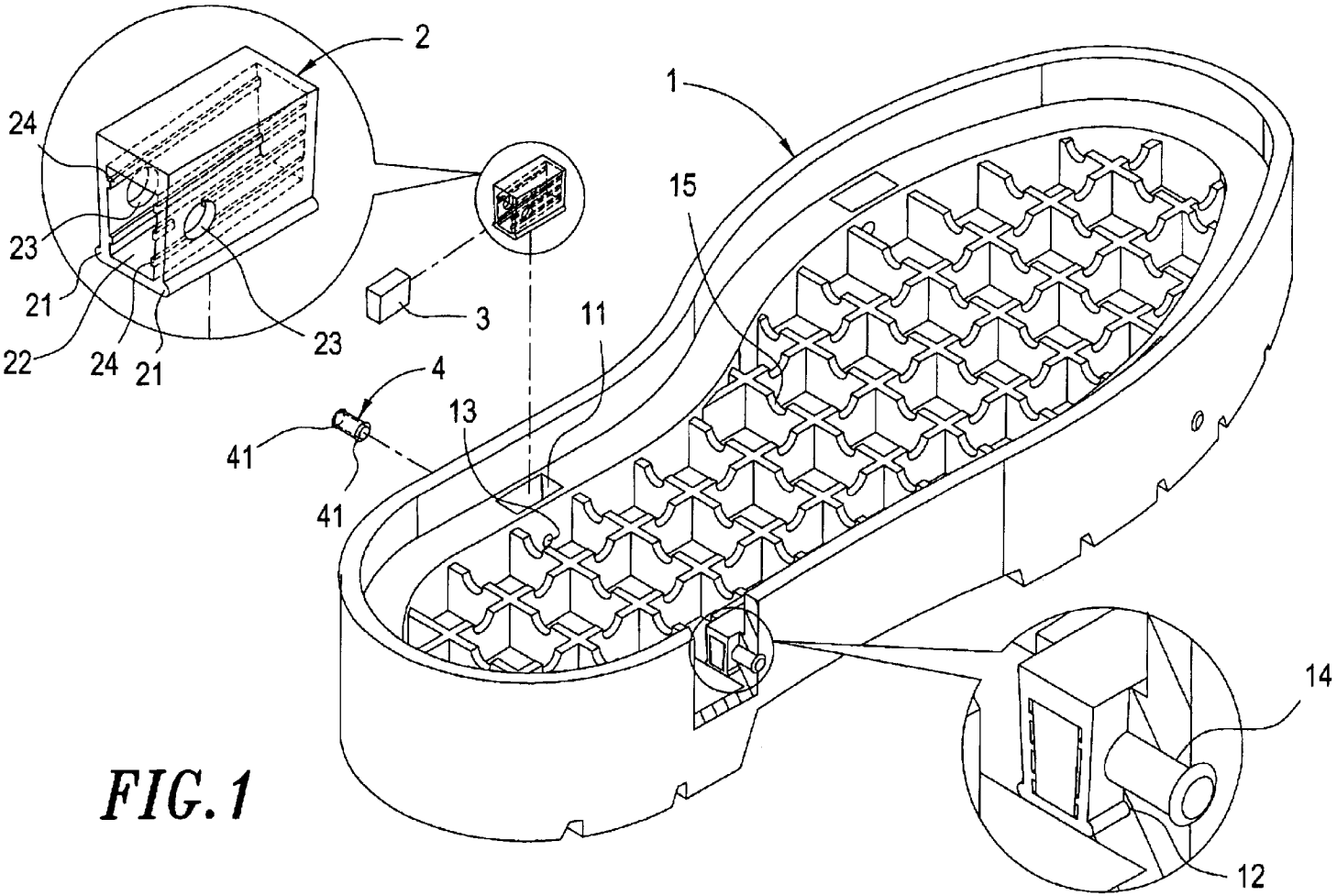
FIG. 1 is a perspective view illustrating one embodiment of the invention.

A shoe bottom sole 1 which includes two corresponding concave chambers 11 on the peripheral lateral edges thereof. The concave chambers 11 are shaped with an upper wider portion and a lower narrower portion and have a concave slide 12 and a vents 13 14 on both sides of the concave chamber 11. One vent 13 of the concave chamber 11 extends inwardly of the sole 1 while the other vent 14 extends outwardly of the sole so that the vents allow air to enter into a plurality of channels or chambers 15.

A sliding chamber 2 has an upper wider portion and a lower narrower portion and includes a slide 21 which is seated on a base 22 in the slide chamber 2 and is disposed at an angle. The slide chamber opens to a vent 23 on both sides of the chamber. The vent is constructed and arranged with the corresponding position with the vents on the sole. A plurality of slide rails on both lateral sides of the slide base 22 lessens the friction or force caused by the sliding of a slid block 3 inside the slide chamber.

The slide block 3 which is approximately the same size as the slide base 22, is adapted to move back and forth in the slide chamber.

A water-proof ring 4 includes a convex edge 41 on both ends of the water-proof ring 4.

Figure 2:
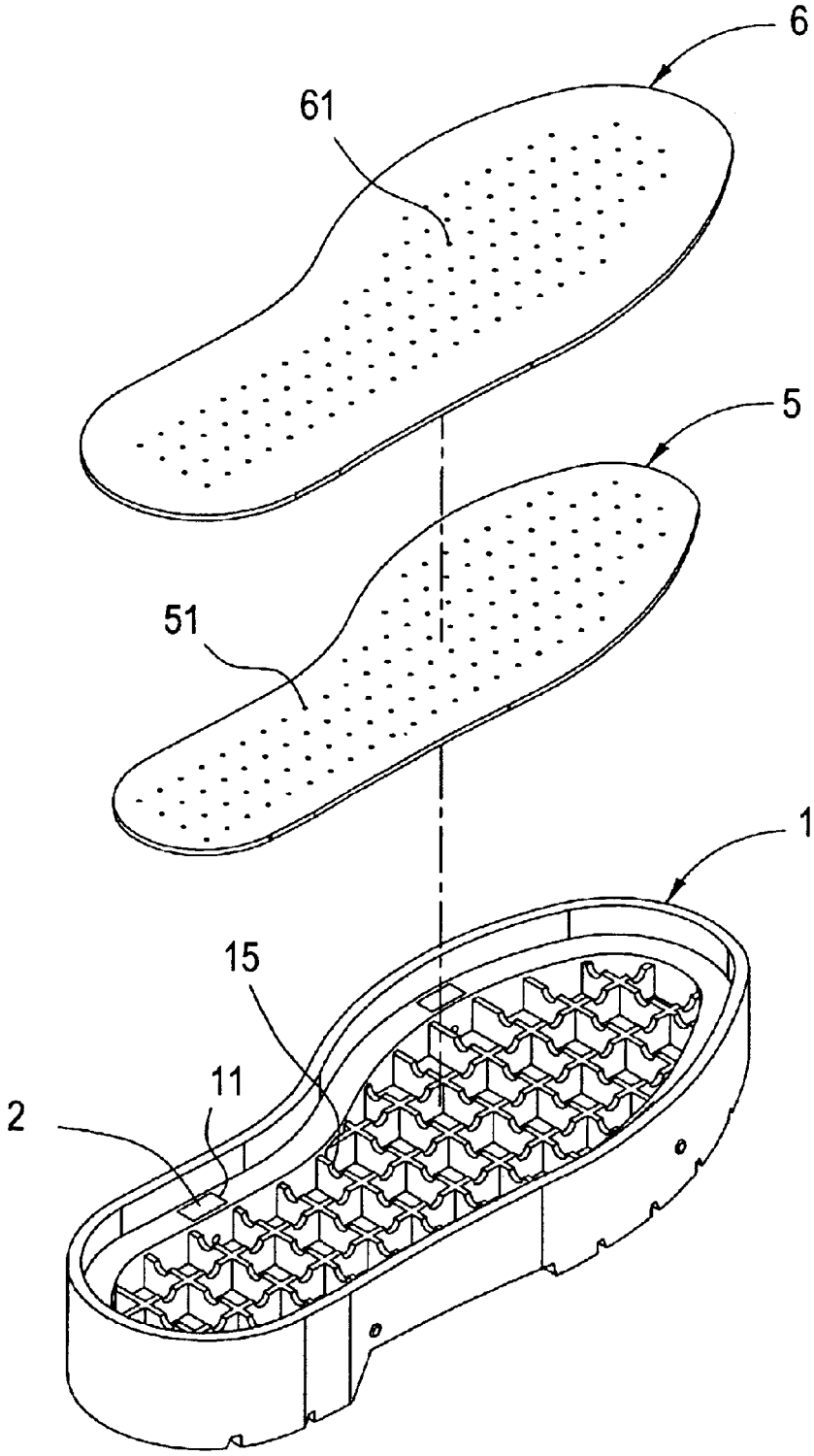
FIG. 2 is a perspective view illustrating a second embodiment of the invention.

As shown in FIG. 2, an inner sole 5, and an upper sole 6, fits on top of or rests on a plurality of interconnected chambers 15 of the sole 1 to form a plurality of hollow chambers that cover the sole below the inner and upper soles. The inner and upper soles 5 and 6 each include a plurality of openings therein to allow air to pass therethrough and also provides sufficient thickness for the comfort of an individual. The plurality of openings is indicated by numerals 51 and 61.

Figure 3A:
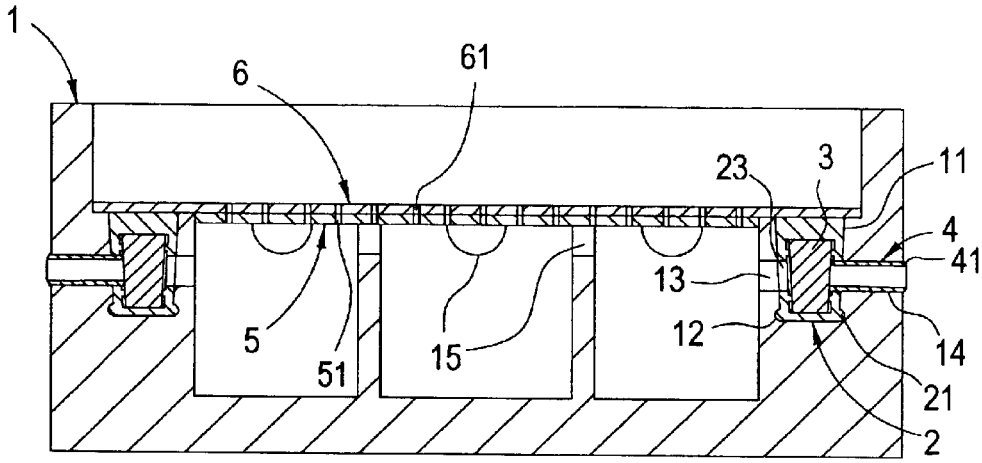
FIG. 3A, is a cross-sectional view of the sole structure as shown in FIG. 2 illustrating the vent in a closed position.
Figure 3B:
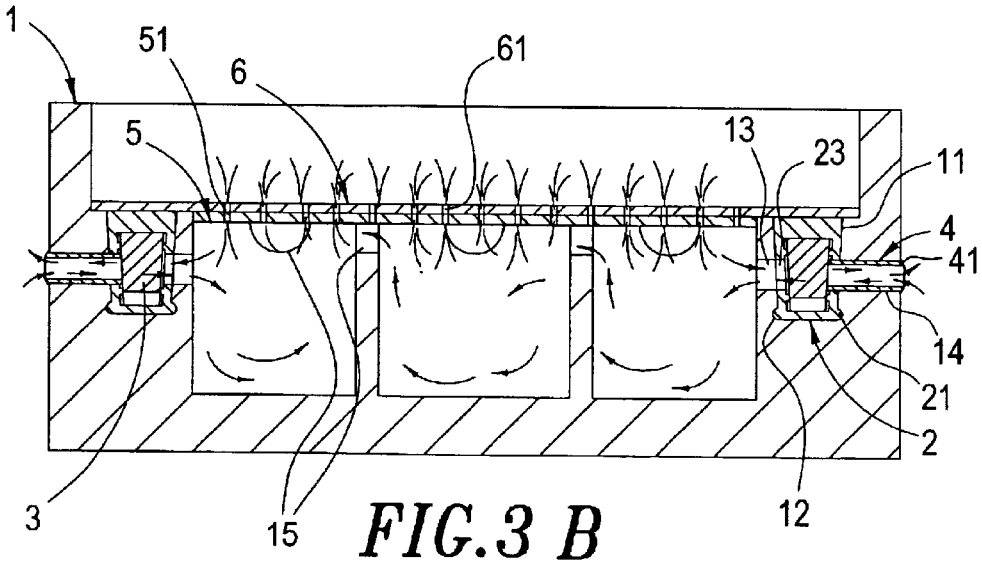
FIG. 3B, is a cross-sectional view of the shoe structure shown in FIG. 2 but illustrating the passage of air through the sole.
Figure 4A:
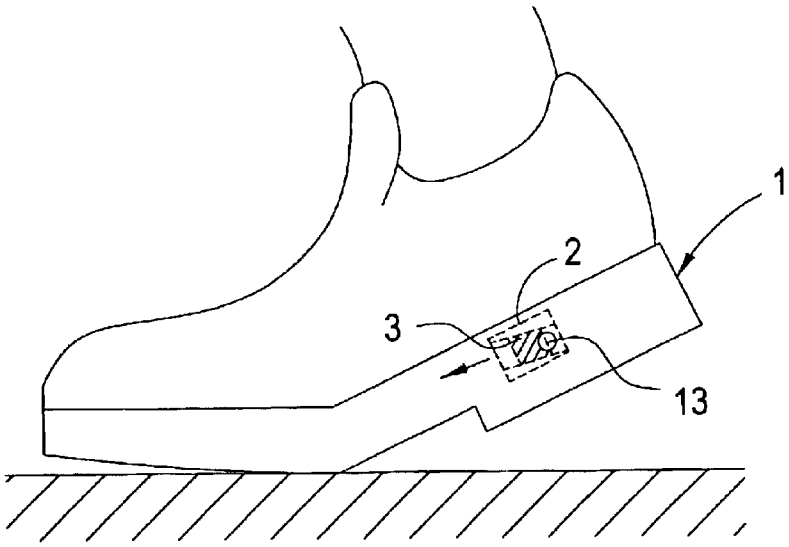
FIG. 4A, is a side elevational view which illustrates the slide assembly in a closed position.
Figure 4B:
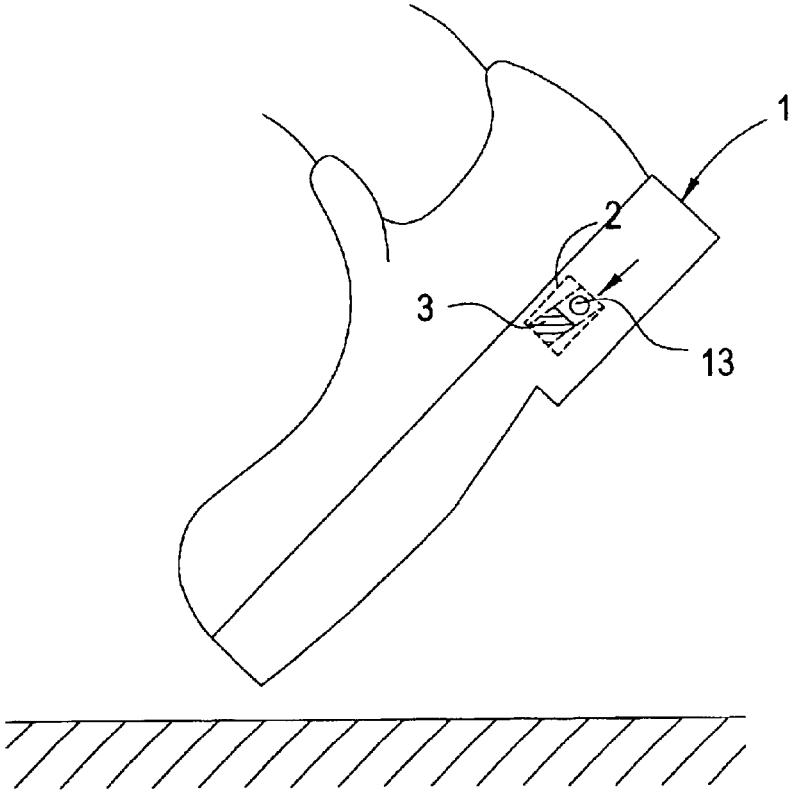
FIG. 4B, is side elevational view illustrating the slide assembly in an open position.
Figure 4C:
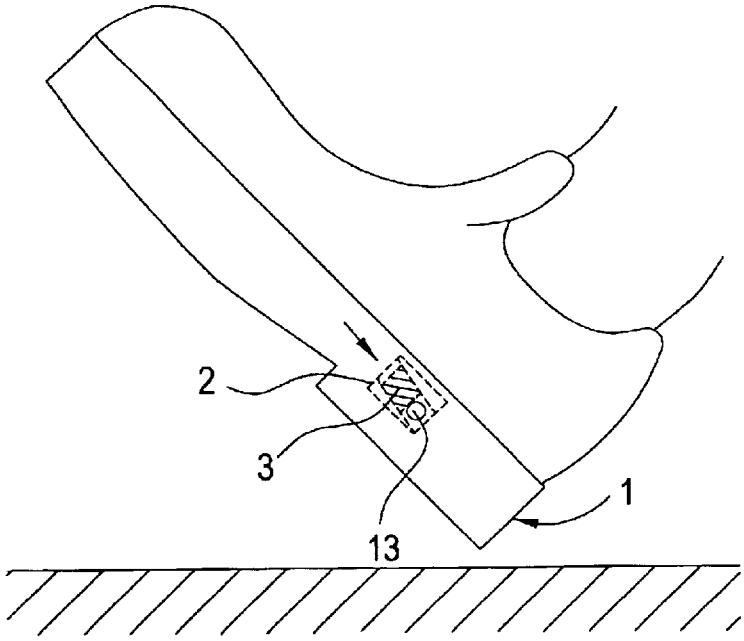
FIG. 4C, is a side elevational view illustrating the slide assembly prior to its movement to a closed position.
Figure 4D:
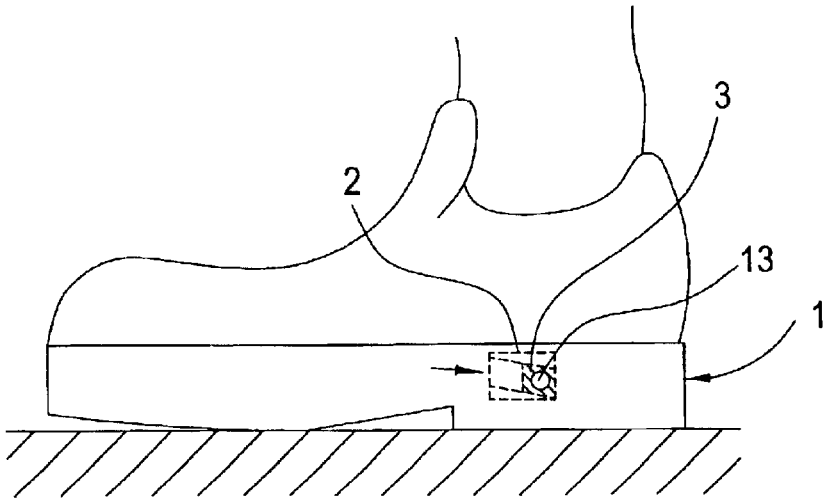
FIG. 4D, is a side elevational view of a shoe structure with the slide assembly in a closed position.
Figure 5:
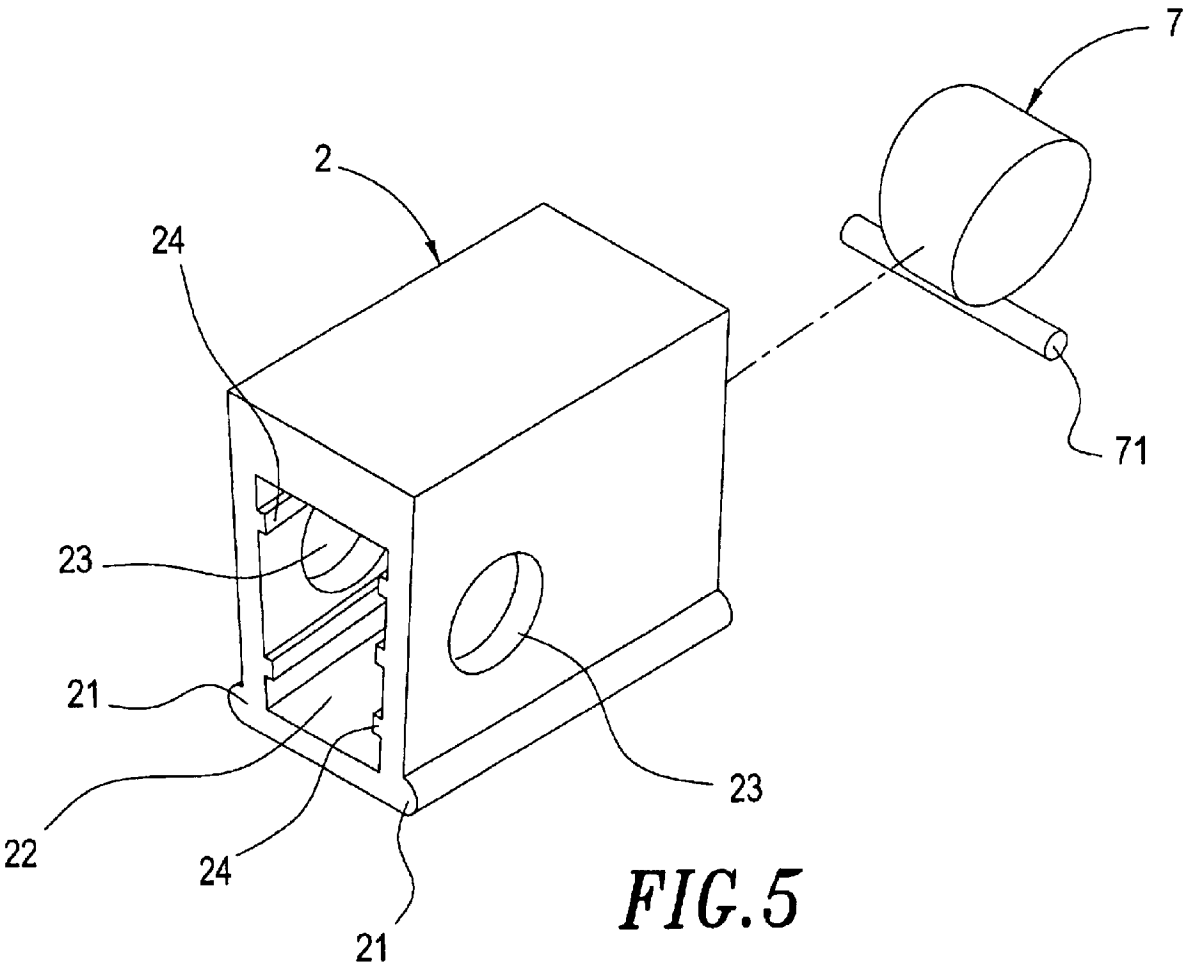
FIG. 5, is a perspective view illustrating one embodiment of the invention.
Figure 6A:
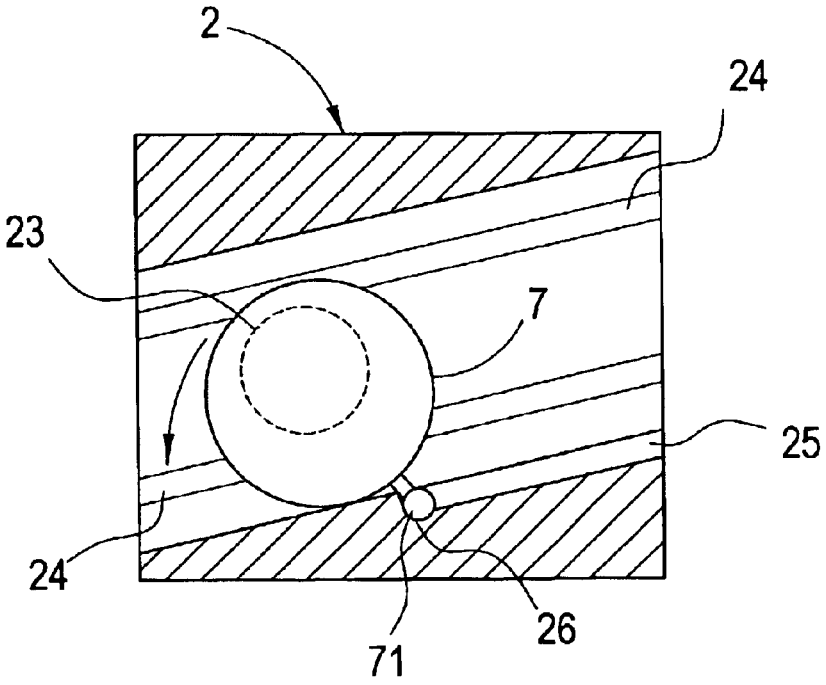
FIG. 6A, is a cross-sectional view of the slide assembly which shows the slide assembly in an open position.
Figure 6B:
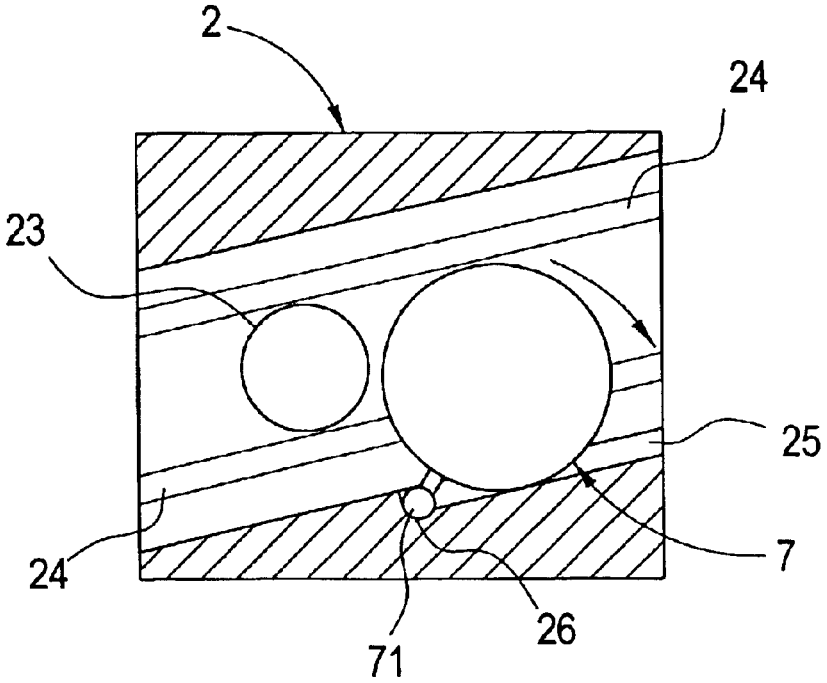
FIG. 6B, is a cross-sectional view of the slide assembly which shows the slide assembly in a closed position.

FIGS. 3 and 4 illustrate the operation of the invention. As shown in FIG. 3A water and air are prevented from entering the sole of the slide block. By contrast, when the slide block is moved forwardly opening the vent 14 air is allowed to enter into the chambers 15 and circulate through the sole and upwardly through the middle and upper soles. As shown in FIGS. 4 A–D the following movements of the foot open and close the vent 13. For example, when an individual steps forward he first lifts the heel of the shoe or boot so that the sliding block 3 moves inside the slide chamber 2 of the sole 1. As shown, the slide block moves forward because of the influence of the angle of the sole. When his foot is lifted to its upper most point, the vent 23 will be open completely as shown in FIG. 4B so that the air enters into the sole 1 through the vent 14 and thus the fresh air flows inside the sole. However, as illustrated in FIG. 4C the sliding block will close the vent due to the influence of the inclination of the slide base 22 and the gravitational force to prevent water from entering into the sole. The fresh air will be flowing into the sole by means of the vents in the inner and upper soles 5 and 6 such that the user will feel comfortable and cool.

A slide block 7 is shown prior to entry of and passing through the slide chamber with a rod 71 at the lower portion thereof. In this embodiment of the invention, a guide group 25 is provided in one portion of the slide chamber together with a stop 26 in the base of the slide chamber 2. The rod 71 fits inside the groove 26 which acts as a stop wherein the vent 23 will be closed by the slide block 7 to prevent the entrance of water from the vent. When the chamber is inclined rearwardly the vent is opened.

The structure of the sole of this invention has the following advantages in comparison with other conventional technologies:

1. It utilizes the principle of a sliding block moving back and forth so that fresh air can enter a shoe when an individual walks and water is excluded.

2. When the air enters into the sole, the air, after passing through each chamber will spread out over the shoe.

3. The construction of this invention provides people with convenient product with practical usage.

While the invention has been described in connection with its preferred embodiments it should be recognized that changes and modifications may be made therein without departing from the scope of the appended claims.

What is claimed is:

1. A shoe sole structure comprising a bottom sole having two lateral sides, a plurality of interconnected compartments and an inner sole having a plurality of openings therein covering said interconnected compartments, and a hollow slide chamber in each of said two lateral sides, and each of said hollow slide chambers having a wider upper portion and a narrower lower portion, and a slide block having a wider upper portion and a narrower lower portion disposed in each of said slide chambers and constructed and arranged to slide back and forth in said chamber, a vent on each side of said hollow chamber for allowing air to pass therethrough when said slide block is in a first position and a tubular element including an outer ring at each end thereof connecting said vent in said hollow chamber with the outside of the sole for allowing air to flow from the atmosphere into the hollow chamber when the slide block is in a first position and wherein said side block closes said opening in the said hollow chamber when said side block is in a second position to thereby prevent water from entering said sole through said tubular element.

2. A shoe sole structure according to claim 1, wherein said slide chamber includes an angled base.

3. A shoe sole structure according to claim 2, wherein the slide chamber includes a rail on said base thereof for reducing friction.

4. A shoe sole structure according to claim 3, which includes a middle sole having a plurality of openings therein between said upper sole and said plurality of interconnected compartments.

5. A shoe sole structure according to claim 4, in which said interconnected compartments have a generally square cross-section.

* * * * *